United States Patent [19]

Day

[11] Patent Number: 4,870,462

[45] Date of Patent: Sep. 26, 1989

[54] SLUG FLOW AIR STREAM APPARATUS FOR DRYING LIQUID TONED IMAGES

[75] Inventor: Gene F. Day, Hillsborough, Calif.

[73] Assignee: Precision Image Corporation, Calif.

[21] Appl. No.: 245,653

[22] Filed: Sep. 15, 1988

[51] Int. Cl.[4] ..... G03G 15/10

[52] U.S. Cl. ..... 355/256; 118/63; 118/659; 34/122

[58] Field of Search ..... 355/296, 307, 256.8; 118/63, 652, 659–662; 34/122

[56] References Cited

U.S. PATENT DOCUMENTS

| | | | |
|---|---|---|---|
| 3,196,832 | 7/1965 | Zin | 118/637 |
| 3,741,643 | 6/1973 | Smith et al. | 355/256 |
| 4,026,701 | 5/1977 | Till et al. | 355/296 X |
| 4,198,923 | 4/1980 | Blumenthal | 118/660 |
| 4,383,019 | 5/1983 | Simm | 430/45 |
| 4,449,475 | 5/1984 | Schinke | 118/645 |
| 4,477,287 | 10/1984 | Kush | 134/15 |
| 4,693,206 | 9/1987 | Day | 118/631 |

*Primary Examiner*—A. T. Grimley
*Assistant Examiner*—J. Pendegrass
*Attorney, Agent, or Firm*—Thomas Schneck

[57] ABSTRACT

A drying apparatus for printers and copiers using liquid developers or toners having an air bar which is resiliently biased into contact with a supported surface having a developed image. The air bar has an air-release side that includes a bearing surface and a wedge edge spaced apart from the bearing surface by a plenum slit. The release of pressurized gas, preferably air, through the plenum slit overcomes the bias of the air bar against the surface until an equilibrium position is reached wherein the air bar is spaced apart from the tensioned surface by a predetermined slight distance. Gas escaping between the bearing surface and tensioned surface acts as an air bearing, while the portion of the gas which escapes between the wedge edge and tensioned surface provides a high velocity shearing stress in a slug flow fluid low mode which removes the excess liquid from the tensioned surface. The escaping pressurized gas is then captured and recycled for return to the air bar.

18 Claims, 3 Drawing Sheets

SLUG FLOW AIR STREAM APPARATUS FOR DRYING LIQUID TONED IMAGES

TECHNICAL FIELD

The present invention relates to apparatus for removing excess fluid from a supported surface in electrostatic or electrophotographic copiers and printers.

BACKGROUND ART

In electrographic printing and copying, liquid toner compositions are frequently applied to an electrostatic latent image formed on a dielectric surface in order to develop the image. The dielectric surface may be a coating on a sheet or web of paper to which toner is applied. Alternatively, the dielectric surface may be the charge retentive surface of a drum, belt or the like from which toner applied thereto is transferred to a sheet or web of plain paper. The electrostatic latent image may be established through electrostatic induction by a charged writing head, by ion projection, or through photoconduction, as in photographic copiers or laser printers. The toner is a mixture having pigments or dyestuffs combined with a plastic or resinous binder, hereafter called "solid pigment particles" or "colorant", with very small amounts of added charge control agents, both dispersed in a large volume of liquid dispersant, primarily solvent. One commonly used solvent is an isoparaffinic hydrocarbon available under the trade name Isopar, manufactured by Exxon Corporation.

Whether the image is formed directly on a sheet of paper or is transferred to a sheet of paper after formation on a dielectric surface, the toned image surface will carry not only the solid pigment particles but also some amount of liquid dispersant. In the case of a transferred image, at least a portion of this remaining liquid dispersant will transfer to the paper sheet along with the image. After exit of the sheet of paper from the printer or copier, the liquid dispersant vaporizes. The emission of hydrocarbon vapor into the atmosphere of an office or workplace has been perceived as a matter for concern. A machine which continually puts out wet sheets may cause a build-up of hydrocarbon vapor above the prescribed safety limits and is likely to cause irritation to those persons in the area around the machine. This has become popularly known as the "sick building" syndrome.

Therefore, one aim in the design of printers and copiers is to reduce to a minimum the emission of hydrocarbons into the ambient atmosphere. U.S. Pat. No. 4,693,206 issued to Day and assigned to the assignee of this application teaches a drying roller which comes into frictional contact with a dielectric sheet after development of a latent image on the electrostatic sheet. The drying roller removes a large percentage of the excess liquid dispersant to produce relatively dry paper.

The use of airflow as an alternative to a drying roller is known. U.S. Pat. No. 4,198,923 to Blumenthal discloses a toner clean-off head which employs a high vacuum to insure proper engagement between the head and a sheet of paper. The sheet of paper is drawn over the curved clean-off head for removal of the excess toner by suction. Conversely, U.S. Pat. No. 4,383,019 to Simm teaches fixing an air jet member at an angle relative to an image carrier-band. The use of drying rollers, air suction, and the air jet member of Simm all provide a relatively dry sheet of paper, but it is recognized in the art that improvements may be made in drying apparatus. Moreover, air drying is often inadequate in reducing the emission of hydrocarbons, since the vapor-laden air carries the hydrocarbons into the ambient atmosphere. The efficiency of a drying apparatus is partly a function of the distance between the apparatus and the surface to be dried. In determining the position of the jets of Simm, the eccentricities of the surface to be dried must be considered thereby limiting the minimum distance from which the air jet can be projected.

It is an object of the present invention to improve upon the drying apparatus and to significantly reduce the emission of hydrocarbons from a printer or copier.

DISCLOSURE OF THE INVENTION

The above object has been met with a super high velocity air flow generating structure disposed adjacent to a supported surface having a liquid layer thereon. The structure utilizes shearing stress to remove excess liquid by slug flow. The structure has an air-release side having an edge-forming wedge surface and a bearing surface spaced apart from each other by a plenum slit.

The structure is elastically urged into contact with a supported surface. This surface may be an electrostatic sheet or web or it may be an intermediate surface, such as a drum, on which the latent image is first developed and then transferred to a sheet of paper. Contact with the supported surface blocks the plenum slit. However, a source of pressurized gas is in fluid communication with the structure to release gas, preferably air, through the plenum slit. In a first embodiment, the structure is an air bar with some portion of the escaping air progressing between the supported surface and the bearing surface of the air bar. Thus, an air bearing is formed as the floating air bar finds an equilibrium position in which both the edge formed by the wedge surface and the bearing surface are spaced apart from the supported surface.

A second portion of the pressurized gas projected through the plenum slit escapes through the space formed between the edge and the supported surface. In various embodiments this escape of pressurized gas maintains the edge in spaced apart relation with the supported surface. It is the escape of the second portion of pressurized gas which provides a shearing stress for drying of the supported surface. In contrast to air knives that are used in a drying process, here high velocity air flow in a slug flow pattern is created by the surface undergoing drying since it is the close proximity of the supported surface and the air bar structure, which provides the lower limit for the passage of air. It has been discovered that the power of the floating air bar provides unexpected results when compared to the drying ability found in the prior art. It is believed that high velocity air moving "upstream", i.e. toward the advancing wet surface, and in very close proximity to the surface, distinguishes the present invention from air knives and provides an unexpected result.

An advantage of the present invention is that the present invention greatly reduces the amount of liquid which is carried by a sheet of paper exiting from a printer or copier. The liquid carried on a sheet of paper is a major source of emitted hydrocarbon vapor into the atmosphere in electrostatic printing and copying. Another major source is the pressurized gas which is blown from an air jet during drying, only to escape into the ambient atmosphere. The present invention, however, includes recirculation to control this second major source of emitted hydrocarbons. A dramatic improvement in reducing emitted vapor is therefore realized.

BEST MODE FOR CARRYING OUT THE INVENTION

Figure 1:
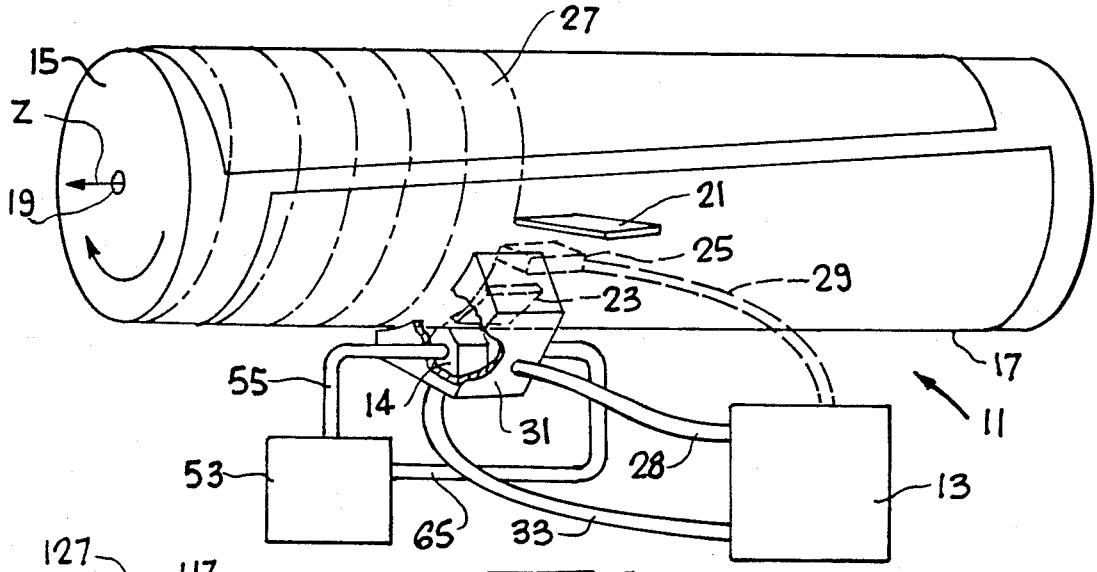
FIG. 1 is a perspective view of an electrostatic printer employing the drying apparatus of the present invention.
Figure 2:
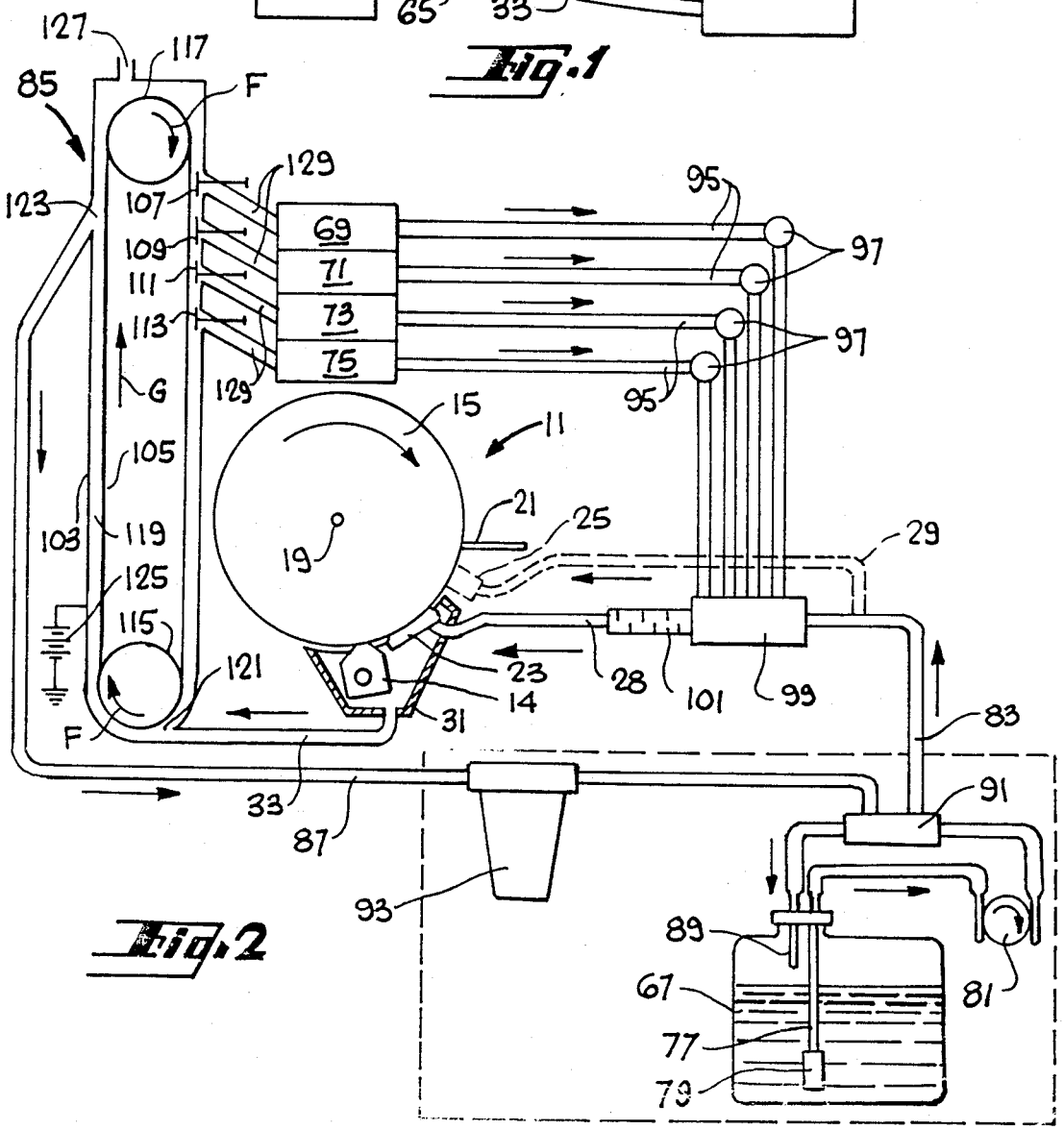
FIG. 2 is a schematic view of a toner recycling system in the electrostatic printer of FIG. 1, including a floating air bar for removing excess fluid.

With reference to FIG. 1 and 2, an electrostatic printer 11 with a toner recycling system 13 employs an air bar 14 described below. The air bar 14 can also be employed for developing nonelectrostatic media. In the electrostatic printer 11, a drum 15 supports a sheet of paper 17 for rotation. An axle 19 located on the longitudinal axis Z through the center of the drum 15 supports the drum and transmits rotational energy from a motor, not shown. The size of the drum 15 may vary, a large size drum typically having a diameter of approximately 12 inches and a width of approximately 52 inches. The sheet of paper 17 is coated with a charge-retaining dielectric medium on which a latent image may be formed and developed. Alternatively, the latent image may be formed and developed directly on a drum, with the developed image later transferred onto a sheet of plain paper.

An electrostatic head 21 for creating an electrostatic latent image is in mechanical contact with the sheet 17, applying charge thereto. The head may comprise a linear array of wires forming charging elements, the forward edge of which is in very close proximity to the sheet of paper 17. The head 21 is typically only a fraction of the width of the sheet and is translated laterally, parallel to the longitudinal axis Z of the drum 15 so that a helical stripe pattern 27, indicated by dashed lines, is traced on the sheet. Alternatively, the head 21 may be a full-width head which is fixed in position. The number of wires in the head may range from 100 to 20,000. The charging elements are at a negative potential of 400 to 600 volts relative to a drum at ground or at a positive potential. Polarities may be reversed.

A toner applicator 23 follows the head 21 and applies liquid toner for developing a latent image existing in the charge pattern deposited on the sheet of electrostatic paper 17. The latent image created by the head 21 is thus formed into a visible image. The toner applicator 23 may be a toning shoe, as shown, which supplies the fluid toner locally to the sheet of paper along the helical stripe pattern 27, or may alternatively be a full drum width toning fountain or pool applicator. A prewet station 25 located between the head 21 and the applicator 23 may be included to wet the latent image prior to toning. The wetting at the prewet station 25 is provided by a clear fluid dispersant, such as the hydrocarbon sold under the trade name Isopar by Exxon Corporation. The prewetting can enhance toning contrast and greatly reduce background marking.

Liquid toner is applied to toner applicator 23 from the toner recycling system 13 through an inlet tube 28. Likewise, if desired, clear dispersant may be supplied to the prewet station 25 from the toner recycling system through a second inlet tube 29. Excess toner falls into a sump at the bottom of a hood 31 for collection and return through a drain pipe 33 to the toner recycling system 13.

Figure 3:
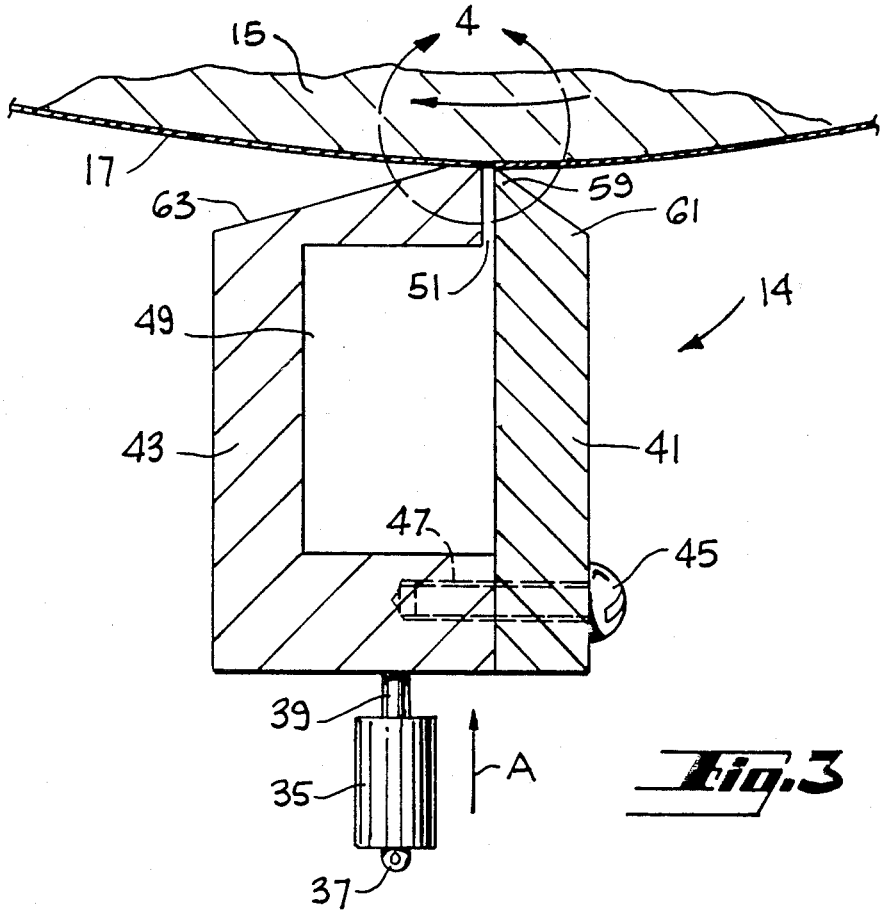
FIG. 3 a side sectional view of the floating air bar of FIG. 2.
Figure 4:
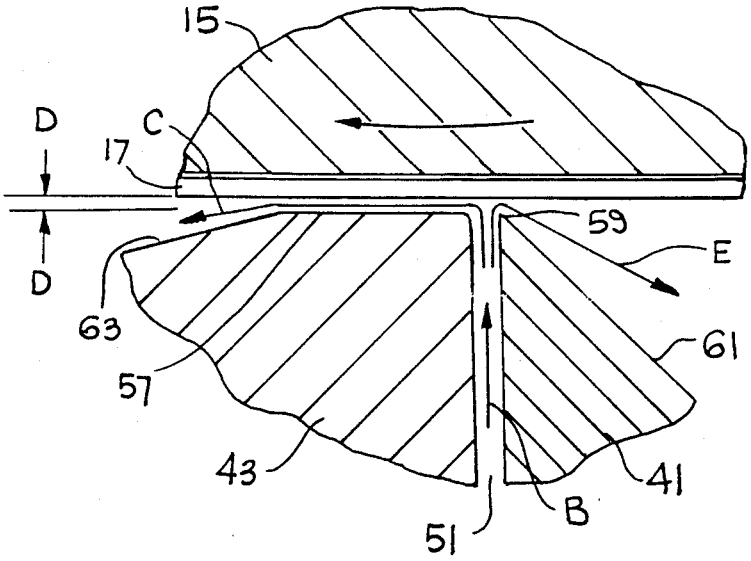
FIG. 4 is an enlarged sectional view of the floating air bar of FIG. 3 taken along lines 4—4.

It is the function of the air bar 14 to remove the excess toner fluid from the sheet of paper 17. Referring now to FIGS. 1, 3 and 4, the air bar 14 is a floating member that is urged by a piston 35 or other means into frictional contact with the sheet of paper 17 supported on the drum 15. A mounting bracket 37 on the piston 35 ensures that the piston is vertically stationary relative to the sheet of paper 17 but the piston rod 39 presses the air bar in the direction of arrow A. The biasing of the piston rod 39 may be provided by a spring housed within piston 35, or may be provided hydraulically or with air pressure. Typically, the force is approximately 0.5 pounds.

The air bar comprises a wedge member 41 and a bearing member 43. The wedge member is secured to the bearing member by an externally threaded screw 45 that is received within an internally threaded bore 47 of the bearing member. The bearing member 43 has a generally C-shaped construction to form a plenum 49 within the interior of the air bar 14. The plenum 49 extends longitudinally along the air bar, as does a plenum slit 51 at the upper extent of the air bar. The plenum slit is formed by the spacing apart of internal walls of the wedge member 41 and the bearing member 43.

The floating air bar 14 as shown in FIG. 3 appears to be in a rest position, with the air bar in frictional contact with the paper 17. In such a position the plenum slit 51 is blocked so that the plenum 49 is not in fluid communication with the ambient atmosphere. However, the plenum 49 is connected to a source of gas 53 via a source tube 55, shown in FIG. 1 The source 53 supplies a stream of gas, preferably air, to the plenum of the air bar. As will be explained more fully below, the source 53 includes air return and recirculation means for keeping hydrocarbon vapor from mixing with ambient air.

The plenum 49 of the air bar 14 is an enclosed volume with the exception of the opening provided by the plenum slit 51. Thus, as shown by arrow B in FIG. 4, pressurized gas from the plenum is injected into the plenum slit 51. The pressurized gas impinges upon the sheet of paper 17 and a portion of the pressurized gas, represented by arrow C, escapes in the direction of paper movement. The uppermost side of the air bar 14 is an air-release side. The bearing member 43 of the air-release side includes a bearing surface 57. A portion of the escaping air passes between the bearing surface 57 and the paper 17. The interaction of the escaping pressurized gas with the surface of the sheet of paper 17 provides a force which removes the air bar from the sheet of paper by the spacing indicated by arrows D.

Another portion of the pressurized air from the plenum slit 51 escapes in a direction opposite the direction of paper movement. This portion travels over an edge 59 of the wedge member 41 and is represented by arrow E in FIG. 4. The sheet of paper 17 is supported on a cylindrical drum 15 but, because of the small size of the bearing surface 57, the bearing surface may be planar and still nearly equidistantly spaced from the paper at both the forward and rearward extents of the bearing surface. Alternatively, the bearing surface may have a radius of curvature equal to that of the drum on which the sheet of paper is supported. A sharp or pointed surface 61 of the wedge member 41, on the other hand, must be at an angle relative to the sheet of paper.

Optimally, the pointed surface 61 of the wedge member 41 peaks at an extremely acute angle relative to the parallel walls which form the plenum slit 51. However, because of mechanical tolerances and because of mechanical wear, a perfect edge is not possible. That is, a small land will form at the edge 59. It is important that the angle of the surface 61 be steep. The greater the angle, the narrower the land as the wedge member 41 wears. Typically, the angle is within the range of 20° to 45°. Depending on the mechanical strength of the materials used in constructing the air bar, an angle of much less than 20° jeopardizes the integrity of the wedge member 41.

Figure 5:
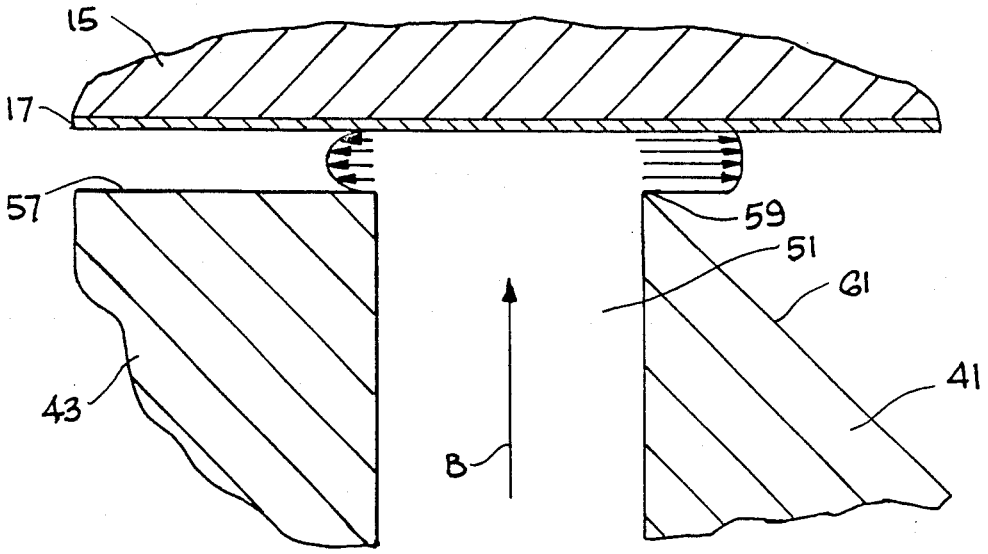
FIG. 5 is an enlarged section view of the floating bar of FIG. 4

In operation, best viewed in FIGS. 3 and 5, the drum 15 supporting a sheet of paper 17 is rotated in a clockwise direction so that the portion of the paper which approaches the edge 59 contains a developed image. In development, the sheet of paper will pick up an excess of fluid. The excess of fluid is removed by the portion of pressurized gas, which is projected from the plenum slit 51 over the edge 59. Because the air bar 14 is a floating member, the gap between the edge 59 and the supported sheet of paper 17 may be kept to an extremely small distance which amounts to nominal contact between the air bar and the supported sheet surface. The distance is determined by an equilibrium position of the air bar and is preferably 5 microns but may be in the range of 1 to 50 microns.

Piston 35 provides a force which presses the air-release side of the air bar 14 against the sheet of paper 17. The escape of air between the bearing surface 57 and the sheet of paper, however, acts as an air bearing to prevent contact of the air bar with the sheet of paper. The force of the pressurized air within the plenum 49 may be slightly above atmospheric pressure, or may reach as much as 50 psi or more. A greater air pressure provides a more efficient drying process, but increases the expense of the drying system. A spacing between the air bar 14 and the sheet of paper 17 of approximately proximately 5 microns is optimal, with a spacing of 1–10 microns being a preferred spacing. In order to remain within this range, the force exerted by the piston 35 on the air bar should be increased when the air pressure through the plenum 49 is likewise increased. An advantage of providing a sloped surface 63 on the bearing member 43, rather than extending the bearing surface 57 across the entirety of the bearing member, is that the gas pressure through the plenum 49 may be increased without a significantly greater change in the gap between the air bar and the sheet of paper or excessive force being required to maintain close engagement.

As shown in FIG. 5, the width of the plenum slit 51 greatly exceeds the gaps between the edge 59 and the paper 17 and the gap between the bearing surface 57 and the paper. Thus, there must be a substantial increase in the velocity of air as the air is released from the plenum slit. In contrast to drying air knives which utilize a nozzle to maximize air velocity prior to release, it is the proximity of the edge 59 to the paper 17 which creates the high velocity employed in the present drying process. The width of the plenum slit 51 may be 0.02 inches, for example, while the gap between the edge and the paper is 6 microns. A velocity of 13 ft./sec. within the plenum slit is then translated into a velocity of approximately 1,050 ft./sec. past the edge 59. The velocity of the flow along the bearing surface is within the range of 50 to 100 ft./sec.

Utilizing the surface to be dried, i.e. the paper 17, as one of two boundary surfaces which create high velocity air flow does provide an improvement over air knives. The shearing of excess fluid from the paper 17 is further enhanced by the edge-forming wedge surface 61. Shearing stress is equal to the product of the coefficient of viscosity and the shearing rate, with the shearing rate being equal to the velocity of flow over the spacing between boundary surfaces. The pointed surface 61 stimulates slug flow of air along the wet portion of the paper 17 past the edge 59. Slug flow is illustrated in FIG. 5 by the flow front above the pointed surface 61. The velocity of flow proximate the paper is only slightly less than the maximum velocity.

Slug flow is in stark contrast to parabolic flow, as illustrated along the bearing surface 57. Parabolic flow is a viscous limited flow having a front which fits a parabolic curve with a vertex at the midpoint between the bearing surface and the paper 17. With such a front, the air velocity has a maximum at the vertex and has a minimum proximate the boundary surfaces. This is due to viscous limiting forces which become appreciable in the immediate area of a boundary surface. Because shearing stress is directly proportional to the air velocity at the immediate area of the boundary surface, given a coefficient of viscosity and a spacing, shearing stress is decreased by viscous limiting forces.

The inclination of the pointed surface 61 greatly restricts the viscous limiting forces since the incline drops one boundary surface. While a lessening of velocity at the fringes of a front does occur even in slug flow, the loss of shearing stress is significantly less than if parabolic flow were present atop the wedge surface. Optimally the pointed surface would be at a 90 degree angle relative to the paper 17 so as to minimize viscous limiting forces. However, as noted above, the mechanical tolerances of the wedge member 41 make this impracticable. The angle is typically within the range of 20 degrees and 40 degrees.

It has been discovered that the floating air bar improves the drying process by a factor of at least 10 relative to conventional drying rollers. If the imaging surface is very smooth, it is believed that an improvement factor of 100 or more may be readily achieved. However, should the pressurized gas escaping from the plenum be funneled into the atmosphere, only a portion of this improvement may be realized. The escaping pressurized gas, which is preferably air, is vapor laden and is a second source for the emission of hydrocarbons into the air. Thus, as shown in FIG. 1, the hood 31 which houses the floating air bar 14 captures the escaping gas. A recycling tube 65 is received within the hood 31. The source of pressurized gas 53 draws its supply from the hood 31 via the recycling tube 65, to draw the vapor-laden gas from the hood for return to the source 53. In this manner, a substantial portion of the volume of vapor-laden gas is prevented from reaching the ambient atmosphere. Alternatively, part of the hydrocarbon vapor may be removed from the recirculating air to further reduce unwanted emissions.

Figure 6:
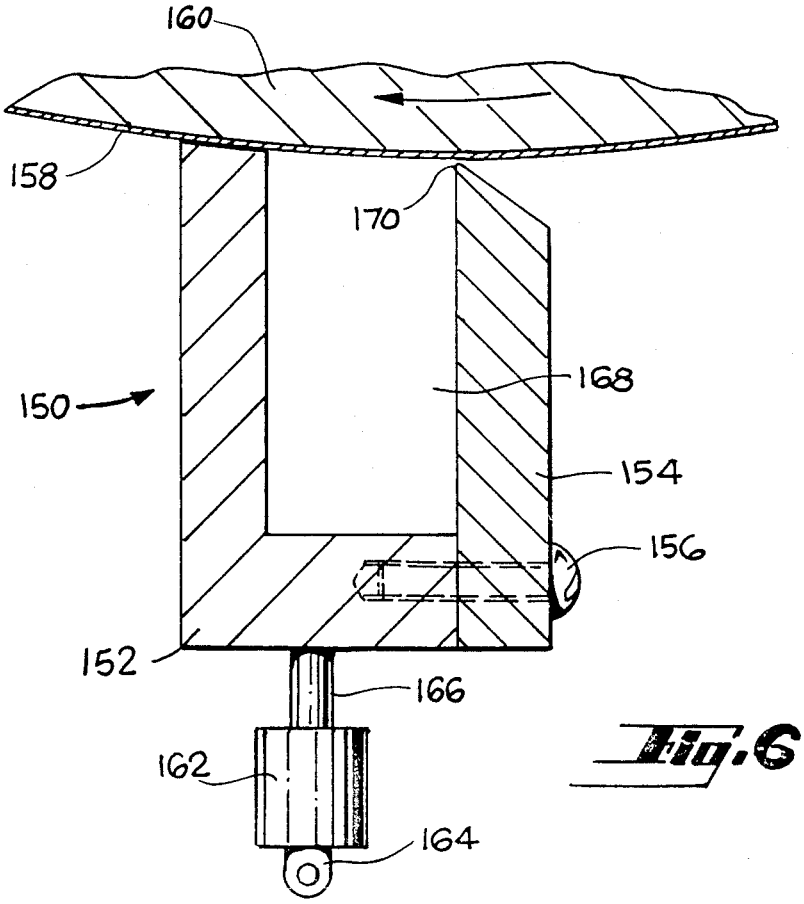
FIG. 6 a side section view of a second embodiment of an air bar in accord with the present invention.

FIG. 6 is a second embodiment of an air bar 150. The air bar 150 includes an L-shaped bearing member 152 and an edge member 154 secured to the bearing member by an externally threaded screw 156. The edge member 154 is both structurally and functionally identical to the edge member described above. The bearing member 152, on the other hand, is structured to frictionally contact the paper 158 supported on the rotatably driven drum 160.

A piston 162 provides an off-center engagement force to the L-shaped bearing member 152. The piston is held stationary by securement of a mounting bracket 164 to a fixed member, not shown, but a telescoping piston rod 166 is connected to the bearing member to apply a force on the bearing member and in the direction of the paper 158. Again, this force is typically 0.5 pounds.

The L-shaped bearing member 152 and the edge member 154 combine to form a plenum 168 that is in fluid communication with a supply of pressurized gas, not shown. The escape of gas, preferably air, from the plenum 168 exerts a force which exceeds the off-center engagement force of the piston 162, thereby distancing the edge 170 of the edge member from the paper to be dried. The bearing member 152, however, remains in frictional contact with the paper.

The opening of the plenum 168 to the paper 158 is not a plenum slit as in the embodiment shown in FIG. 3. Rather, the plenum 168 has an opening which is dimensionally identical to the width of the plenum itself. Thus, it is clear that unlike drying air knives, the high velocity flow of air is created by the paper 158 to be dried and not an air nozzle.

A more complete system, including the present invention, is shown in FIG. 2. The electrostatic printer 11 is seen to include a supply tank 67 of dispersant and a plurality of tanks 69, 71, 73 and 75 of color concentrate. The dispersant is primarily composed of a solvent such as Isopar. Isopar is a registered trademark of Exxon Corporation for a narrow cut isoparaffinic petroleum solvent consisting predominantly of C10 and C11 isoparaffinic hydrocarbons. Other solvents may also be used. The color concentrate contains charge bearing solid pigment particles, typically composed of a pigment or dyestuff coated or mixed with a plastic or resinous binder. Either the dispersant or the color concentrate or both may contain a small amount of charge control agent. Preferably, the dispersant and the liquid phase of the concentrates all contain the same concentration of charge control agent.

Dispersant is continuously pumped from the supply tank 67 through an outlet 77 extending into the supply tank. The outlet 77 terminates in a particle filter 79. The filter 79 is optional. Pumping is performed by a pump 81 which causes the dispersant to be channeled through the outlet 77 and sent along a feedline 83 toward the inlet tube 28 of the toner applicator 23. An inlet tube 29 to an optional prewet station may branch off to feedline 83. Excess toner or dispersant is collected by the hood 31 which communicates via the drain tube 33 with a solids separator 85. After any solid pigment particles have been separated, the dispersant returns to the supply tank 67 via return line 87 and a tank inlet 89. An aspirator 91 between feed and return lines 83 and 87 provides pressure to feed line 83 and suction to return line 87 to aid circulation. A filter 93 may be placed along the return line to filter out any remaining particles from the dispersant. By this means, i.e., pump 81 and the associated lines 28, 33, 77, 83 and 87, a stream of dispersant is continuously circulated from the supply tank 67 to a toner fluid applicator 23 and back to the supply tank.

A set of concentrate feed lines 95 lead from the concentrate tanks 69–75 through injectors 97, which may be injector pumps, to an injection body or manifold 99 in the path of the circulating dispersant. The injectors 97 selectively inject an amount of color concentrate into the stream of dispersant, by means of a particular valve opening or pump actuation. The amount of concentrate injected into the stream of dispersant may be controlled by varying the degree of valve opening or by varying the rate of pumping. Typically, the concentrate has a solids content in a range of 10 to 25 percent by volume.

A mixer 101 between the injector body 99 and the applicator inlet tube 28 mixes the color concentrate and liquid dispersant, causing pigment particles to disperse in the liquid so as to form liquid toner. A typical mixer operates by providing a tortuous path for the stream of dispersant with injected color concentrate. Alternatively, fluid turbulence may be used to insure uniform mixing. The resulting toner is applied to a latent image by an applicator 23 which is part of an electrostatic printer 11 or the like. When a particular color pass is completed, the injector 97 for that color is turned off. Then fluid dispersant from the supply tank 67 continues to be pumped through lines 77 and 83 to the applicator 23 and then back along the return line 87 via the solids separator 85. This continuous circulation of clear fluid dispersant enables the common portions of the toner circulation system to be washed between successive applications of color toner.

The solids separator 85 in fluid communication with the hood 31 receives excessive toner therefrom and separates out the pigment particles leaving substantially particle free dispersant. The solids separator comprising an electrode 103, a particle accumulating surface, here a belt 105, and scraper blades 107, 109, 111 and 113. The belt 105 is an endless metal belt that turns on pulleys 115 and 117, rotating in the direction indicated by arrows F. In this manner, the belt continuously moves past the electrode 103 in the direction indicated by arrow G carrying toner along with it and continually presenting a clean surface to the electrode. The belt and electrode are closely spaced, typically about 30 mil (762 microns) apart, and define a region 119 therebetween. An entrance aperture 121 at one end of the region receives excess liquid toner from the drain tube or ribbon tube 33. An exit aperture 123 is defined at the opposite end of the region 119 from the entrance aperture 121 for removing clear liquid dispersant. The electrode 103 is electrically biased by a power supply 125 so as to repel solid pigment particles and drive the particles toward the belt 105. Typically the electrode 103 has an electrical potential of about 2 kilovolts relative to the belt, and acts like a capacitor. Pigment particles deposit and agglomerate on the belt surface to form a layer of color concentrate that is carried by the belt beyond the electrode to the scraper blades 107–113. As already noted, the remaining substantially particle free liquid dispersant is removed at the exit aperture and returns along the return line 87 to the supply tank 67. A vent 127 may be provided in the solids separator 85 to insure free flow of fluids and effective aspirator suction. Alternatively, pumped flow or downward flow due to gravity may be used to cause the fluid to pass by the electrode 103.

The scraper blades 107–113 are selectively actuated so as to abut the belt 105 beyond the electrode 103. Color concentrate removed from the belt by one of the scraper blades returns to the appropriate concentrate tank 69–75 by way of concentrate return lines 129. For example, the concentrate tanks 69–75 may contain yellow, magenta, cyan and black concentrate respectively. The scraper blade 107 actuates to return yellow concentrate to the tank 69, the scraper blade 109 actuates to return magenta concentrate to tank 71, the scraper blade 111 actuates to return cyan concentrate to the tank 73, while the scraper blade 113 actuates to return black concentrate to tank 75. The number of concentrate tanks and the order of color concentrates may vary from the example given here.

In any case, it is the air bar of the present invention which acts to remove the excess fluid after development of a latent image. While the present invention has been described with respect to an electrostatic printer, it is understood that the present invention is not restricted to electrostatic printing. The air bar may also be used in plain paper copying and the like. It should be understood that the supported surface may be in the form of a web or belt which is supported by virtue of self tensioning of the web or belt.

I claim:

1. A drying apparatus for printers and copiers for removing fluid from a supported surface, comprising, an air bar having an air-release side disposed to be a supported surface, said air bar having an wedge member and a bearing member spaced apart from each other at said air-release side to define a plenum opening, said wedge member having a sharp surface inclined relative to said air-release side to form an edge at said plenum opening, means for resiliently biasing said air bar into a position in which said air bar is in nominal contact with said supported surface, and a source of pressurized gas in fluid communication with said plenum opening of the air bar for release of gas through said plenum opening, pressurized gas flow through said plenum opening escaping between said edge of the wedge member and said supported surface to move said air bar into an equilibrium position in which said wedge member is spaced apart from said supported surface, said pressurized gas removing fluid from the supported surface.

2. The drying apparatus of claim 1 further comprising a means for capturing said escaping gas from the plenum opening and recycling said escaping gas back to the source of pressurized gas.

3. The drying apparatus of claim 1 wherein said air bar has spaced apart internal walls defining an interior plenum, said source of pressurized gas being in fluid communication with said plenum opening via said interior plenum.

4. The drying apparatus of claim 1 wherein said bearing member includes a bearing surface at the air-release side, a portion of said pressurized gas flow through the plenum opening escaping between said bearing surface and said supported surface, thereby spacing apart said air bar and said supported surface.

5. The drying apparatus of claim 4 wherein said plenum opening is defined by spaced apart parallel walls, said walls being perpendicular to said bearing surface.

6. The drying apparatus of claim 4 wherein said sharp surface has a wedge angle in the range of 20° to 45°.

7. A drying apparatus for removing a fluid layer from a surface in a reproduction machine comprising, means for supporting a surface having pigment particles and a layer of carrier solvent thereon, an air bar adjacent said supported surface, said air bar having internal walls defining a plenum within the interior of said air bar and having a longitudinal opening in fluid communication with said plenum and terminating at the exterior of said air bar on a release side adjacent said supported surface, said release side having a bearing surface defining a first longitudinal side of the opening and having a sharp edge defining a second longitudinal side of the opening, means for providing relative motion between said supported surface and said air bar, said opening extending longitudinally in a direction substantially perpendicular to said relative motion, with respect to said relative motion said first and second longitudinal sides of the opening being forward and rearward sides, respectively, means for biasing said air bar into a position in nominal contact with said supported surface, thereby blocking said opening, and means for providing pressurized gas to said plenum for projection from said opening, said projection of pressurized gas forcing said sharp edge into an equilibrium position wherein said sharp edge is spaced apart from said supported surface by a predetermined distance for removing the carrier solvent from the supported surface.

8. The drying apparatus of claim 7 wherein the force exerted by said biasing force presses said bearing surface face for contact with said supported surface, yet said projection of pressurized gas escaping between said bearing surface and said support surface to prevent said contact.

9. The drying apparatus of claim 8 wherein said sharp edge is defined by a wedge surface fixed at an angle relative to said bearing surface, said angle being in the range of 20° to 45°.

10. The drying apparatus of claim 7 further comprising means for capturing gas projecting from said opening and for recycling said gas to said means for providing pressurized gas.

11. The drying apparatus of claim 7 wherein said predetermined distance of said supported surface from said air bar is in the range of 1 micron to 50 microns.

12. The drying apparatus of claim 7 wherein said means for supporting a surface is a rotatably mounted drum and said supported surface is a sheet of paper.

13. A drying apparatus for a reproduction machine of the type which supports an electrostatic image on a sheet by a rotatably driven drum, comprising, a longitudinal air bar having first longitudinally extending internal walls defining a plenum and having second longitudinally extending walls spaced apart to define a plenum slit joining said plenum to the ambient atmosphere, said air bar disposed adjacent the circumference of an electrostatic sheet supported on said rotatably driven drum, said plenum slit extending in a radial direction relative to the axis of said drum, means for biasing said air bar into frictional contact with said electrostatic sheet in a manner to block said plenum slit, and means for providing a pressurized gas to said plenum of the air bar for projection from said plenum slit, thereby overcoming said means for biasing said air bar until an equilibrium position is reached wherein said air bar is spaced apart from said electrostatic sheet.

14. The drying apparatus of claim 13 wherein said plenum slit is aligned to direct said projection of said pressurized gas toward the axis of rotation of said rotatably driven drum.

15. The drying apparatus of claim 13 wherein the pressure of said gas in said plenum is in the range of 10 psi and 50 psi.

16. The drying apparatus of claim 13 further comprising means for capturing said pressurized gas projected from the plenum slit and for recycling said captured gas for return to said means for providing a pressurized gas.

17. The drying apparatus of claim 13 wherein said plenum slit is on an air-release side of said air bar, said air release side having a sharp edge and a bearing surface spaced apart by said plenum slit, said bearing surface being substantially planar.

18. The drying apparatus of claim 13 wherein said equilibrium position of nominal contact between said air bar and said electrostatic sheet is a distance in the range of 1 micron to 10 microns.

* * * * *